US005101739A

United States Patent [19]

Nance et al.

[11] Patent Number: 5,101,739

[45] Date of Patent: Apr. 7, 1992

[54] TIRE GASSIFICATION AND COMBUSTION SYSTEM

[75] Inventors: Daniel Nance, Manti, Utah; Gary A. Towne, Mancos, Colo.

[73] Assignee: Utah Environmental Energy, Inc., Manti, Utah

[21] Appl. No.: 637,344

[22] Filed: Jan. 4, 1991

[51] Int. Cl.[5] ..... F23G 5/12

[52] U.S. Cl. ..... 110/229; 110/242; 110/346; 48/76

[58] Field of Search ..... 48/76, 109, 111; 110/229, 230, 346, 242

[56] References Cited

U.S. PATENT DOCUMENTS

| | | | |
|---|---|---|---|
| 4,234,676 | 11/1980 | Chambers . | |
| 4,561,363 | 12/1985 | Mallek | 110/229 |
| 4,613,408 | 9/1986 | Howard . | |
| 4,648,328 | 3/1987 | Keough . | |
| 4,738,205 | 4/1988 | Beierle et al. | 110/229 |
| 4,846,082 | 7/1990 | Marangoni . | |
| 4,848,249 | 7/1980 | LePori et al. | 110/229 X |
| 4,895,083 | 1/1990 | McDilda . | |
| 4,913,069 | 4/1990 | Schultz et al. | 110/346 |

FOREIGN PATENT DOCUMENTS

| | | | |
|---|---|---|---|
| 0065820 | 5/1980 | Japan | 110/229 |

*Primary Examiner*—Edward G. Favors

*Attorney, Agent, or Firm*—Thorpe, North & Western

[57] ABSTRACT

A system for disposing of materials such as vehicular tires and similar substantially organic matter and generating useful heat therefrom includes a first chamber, referred to as a gassification chamber, capable of holding a plurality of tires. The gassification chamber has an access way allowing for insertion of whole tires therein where they will be burned at a relatively low temperature resulting in incomplete combustion and the generation of combustible gases. A first air inlet is positioned substantially at the bottom of the gassification chamber with a first blower connected thereto. A gas outlet is positioned a first distance above the bottom of the gassification chamber confining the burning to the lower end of the gassification chamber. The combustible gas is removed and is conveyed to the lower end of a second chamber, referred to as a combustion chamber. A second blower is connected to a second air inlet at the bottom of the combustion chamber and an electric arc is used to ignite the mixture of air and combustible gas. A third air inlet is positioned a distance above the second inlet in the combustion chamber, and with a third blower connected to the third air inlet, promotes complete combustion of the combustible gases which are produced in the gassification chamber. The hot combustion products exit the combustion chamber relatively free of pollutants and are directed to a heat exchanger where the heat generated is put to a useful purpose.

21 Claims, 1 Drawing Sheet

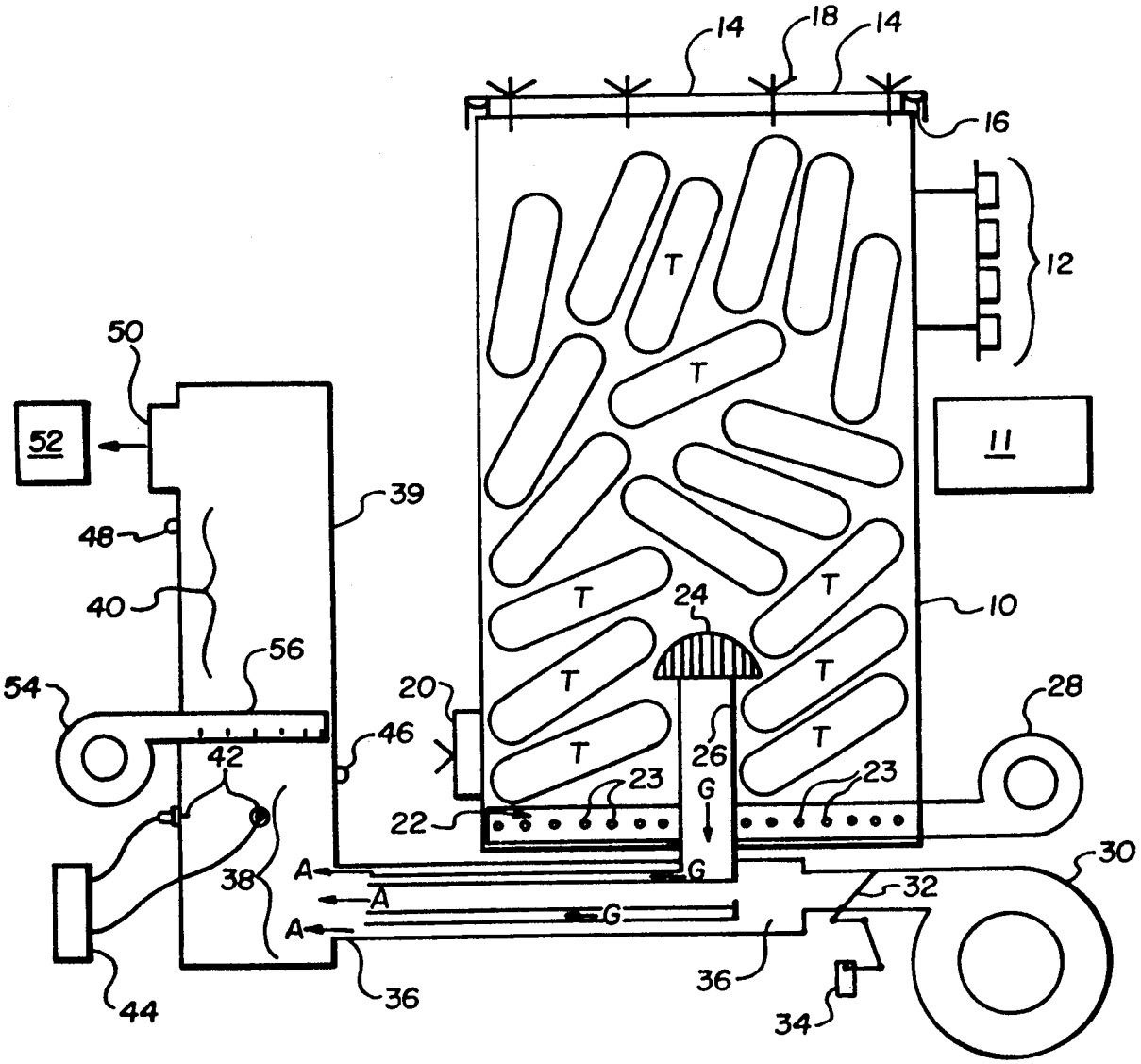
10
11
12
14
14
16
18
20
22
23
23
24
26
28
30
32
34
36
36
38
39
40
42
44
46
48
50
52
54
56
T
T
T
T
T
T
T
T
G
G
G
A
A
A

TIRE GASSIFICATION AND COMBUSTION SYSTEM

BACKGROUND

1. The Field of the Invention

This invention relates to devices used to dispose of used vehicular tires. More particularly, the present invention relates to apparatus and methods for generating useful heat by the destruction of tires and other similar materials.

2. The Prior Art

The disposal of used, worn out, vehicular tires is a major environmental concern. Large piles of old tires is a common sight in many regions of the world. Used tires readily burn and large piles present a serious fire hazard. Moreover, the open air burning of tires creates a thick, noxious smoke which produces health endangering, and very visible, pollution. Even the open air burning of just a few tires can produce a thick smoke plume which can be seen for miles and will linger for hours.

Disposal of old tires, as well as similar organic materials, is a problem which has been the subject of significant research; yet a suitable solution has not yet been available in the art. In order to sponsor research into acceptable methods of disposing of old tires, some governmental agencies regularly charge a tax on the removal of old tires from a vehicle and the mounting of new tires. Still, suitable methods for disposing of used tires have not been found. Ideally, whatever process or apparatus which is used to dispose of old tires and similar wastes, results in useful products in addition to the disposal of the tires in an environmentally acceptable manner.

One such attempt in the art is disclosed in U.S. Pat. No. 4,613,408 to Howard. The Howard device is a destructive distillation device that feeds gases, produced by heating old tires in a sealed chamber, to a fractionation column in an effort to recover useful products from the gas. The Howard device is similar to a coke oven in that heat is applied externally to the airtight chamber holding the tires which acts as a melting pot. The Howard device attempts to recover useful compounds as a by product to the disposal of old tires.

An attempt at a device to cleanly dispose of old tires and obtain useful combustible gas from the disposal process is disclosed in Japanese Patent publication No. 55-65820 to Noboru. The Noboru reference discloses a chamber into which old tires are stacked, burned, and the resulting gas is collected and used as a heat source. Disadvantageously, the arrangement of tires and the inlets and outlets to the chamber results in the tires on the bottom burning much more slowly than the tires on the top of the stack. This results in an inconsistent supply of combustible gas being produced. Using the device shown in the Noboru reference, the gas which is first produced has a relatively high BTU content with the BTU content of the gas quickly dropping off as the tires burn.

Another attempt in the art to obtain useful energy from the disposal of old tires is disclosed in U.S. Pat. No. 4,846,082 to Marangoni. The Marangoni reference burns old tires to generate steam which is in turn presented to a heat exchanger. However, the device disclosed in the Marangoni reference suffers from inefficient operation and results in low useful heat output and the generation of excessive pollutants.

Due to the long felt, and unmet, need in the art for an efficient tire disposal system it would be a great advance in the art to provide a system and method for disposing of used tires and similar materials which consistently produces useful amounts of heat and also minimizes the generation of pollutants.

BRIEF SUMMARY AND OBJECTS OF THE INVENTION

In view of the above described state of the art, the present invention seeks to realize the following objects and advantages.

It is a primary object of the present invention to provide an efficient and economical system and method for disposing of used tires and the like and for creating useful energy therefrom.

It is also an object of the present invention to provide a system and method for disposing of used tires and creating useful energy therefrom which keeps any emitted pollutants at or below acceptable levels.

It is a further object of the present invention to provide a system and method for disposing of used tires and creating useful energy therefrom which generates a dependably constant supply of energy during the operation of the system.

These and other objects and advantages of the invention will become more fully apparent from the description and claims which follow, or may be learned by the practice of the invention.

The present invention provides a system and method for disposing of materials, such as vehicular tires, and producing useful heat thereby. Preferred embodiments of the present invention include a gassification chamber capable of holding a plurality of the material, i.e., tires. The tires are ignited and the amount of oxygen containing gas, e.g., air, which enters the chamber is controlled so that the tires burn or smolder at a relatively low temperature at the bottom of the gassification chamber. The burning of the tires produces a combustible gas which is removed from the chamber.

The gassification chamber is preferably constructed so that only the tires at the bottom end of the chamber burn; as the tires at the bottom of the chamber are consumed, those piled above fall down into the bottom of the chamber where oxygen for combustion is available. Thus, the supply of combustible gas is kept constant during the operation of the system.

The combustible gas which is removed from the gassification chamber is injected into a combustion chamber where it is mixed with air and ignited, preferably by an electric arc. Two air inlets are provided in the combustion chamber, each with their own blower. Providing first and second metered air inlets, the second downstream from the first, provides for more complete combustion. The combustion products are monitored and a means is provided to control the amount of air which is introduced into the gassification chamber at the two inlets in the combustion chamber so that emission of pollutants is minimized and the generation of useful heat is maximized.

BRIEF DESCRIPTION OF THE DRAWING

In order that the manner in which the above-recited and other advantages and objects of the invention are obtained can be appreciated, a more particular description of the invention briefly described above will be rendered by reference to a specific embodiment thereof which is illustrated in the appended drawing. Understanding that this drawing depicts only a typical embodiment of the invention and is not therefore to be considered limiting of its scope, the invention will be described and explained with additional specificity and detail through the use of the accompanying drawing in which:

The FIGURE is a elevational schematic view of the presently preferred embodiment of the tire gassification and combustion system of the present invention.

DETAILED DESCRIPTION OF THE PREFERRED EMBODIMENT

The drawing represents the presently preferred embodiment of the present invention. The illustrated embodiment efficiently disposes of used tires T, as well as similar materials as well, while dependably generating heat which can be used for other purposes.

Represented in the FIGURE is a gassification chamber 10 into which the tires T are placed. In accordance with the present invention, the gassification chamber 10 is an air tight container. A clean out door 20 is provided to allow the removal of the material left after the combustion process has been completed. Such material includes principally clay and metallic waste which remains after the burning of the tires. The size of the gassification chamber 10 may be varied to accommodate an appropriate number of tires T or other organic material of a similar nature.

The gassification chamber 10, and the structures associated therewith, is the presently preferred example of the gassification means of the present invention. Other structures, as will be understood by those having skill in the art after an examination of this disclosure, can be used as the gassification means of the present invention.

The gassification chamber 10 is provided with a lid 14 which forms an air tight seal with the gassification chamber 10. A gasket 16 fabricated from a temperature resistant material and is provided on the periphery of the lid 14. A plurality of bolts 18 are provided. The bolts 18 are just one example of numerous structures known in the art which can be used to fasten the lid 14 to the gassification chamber devices. Such control and measurement devices preferably include a microprocessor 11 which is connected to other apparatus structures as is known in the art control panel, indicated at bracket 12, is provided as a convenient location to mount various control and measurement devices.

It will be appreciated that the represented embodiment disposes of tires batch-by-batch. Those skilled in the art will also appreciate that embodiments of the present invention may be adapted to continuously accept tires and other similar material. For example, an air lock can be provided on the gassification chamber so that the apparatus can be operated continuously without stopping. The used tires T are preferably placed inside the gassification chamber 10 in a random fashion thus making loading of the gassification chamber 10 convenient and not requiring any particular pattern for loading.

Significantly, the gassification chamber 10 functions to cause incomplete combustion of the tires T. The incomplete combustion of the tires T generates hydrocarbons and carbon monoxide which are fully combusted in later stages of the system.

To start the process, the tires T are ignited at the bottom of the gassification chamber 10 through clean out door 20. In the illustrated embodiment, for example, about 300 pounds of tires T, can be loaded into the gassification chamber 10. If necessary, a flammable gas, such as propane, can added to the air forced into the gassification chamber 10 to start the burning of the tires T.

At the bottom of the gassification chamber 10 a tuyére 22 is provided. The tuyére 22 can be any one of a variety of shapes; the shape should provide the most even distribution of air possible. The tuyére 22 includes a plurality of holes through which air enters the gassification chamber 10.

The tuyére 22 is one preferred example of an inlet means in accordance with the present invention. Importantly, other structures performing similar and equivalent functions can also serve as the inlet means of the present invention.

During operation, air is forced into the tuyére 22 by blower 28. The blower 28 can be one of many available in the art; one identified in Grainger catalog no. 376 as no. 4C444 is preferred. The operation of the blower 28 is controlled so that the tires burn, or smolder, at a relatively low temperature.

The low temperature burn desirably causes gases to be generated which will later be fully combusted. The temperature in the gassification chamber 10 is preferably maintained below 400° F. and most preferably in the range from 220° F. and 260° F. when old tires T are being the material being disposed. The low temperatures in the gassification chamber 10 allows the sulfur present in the organic materials to combine with the iron in the metals found in the tires T. In this way, the amount of sulfer compounds which are emitted as pollutant is kept desirably low.

Other temperature ranges may need to be used as different materials are utilized and as different embodiments of the invention are used. Moreover, the temperature will be hotter, and will vary widely, in different portions of the gassification chamber 10. As will be explained shortly, the volume of air which is moved by the blower 28 is controlled so that the desired temperature is maintained, and the proper amount of gas, and gas with the desired BTU content, is generated.

The gases exit the gassification chamber 10 through a grate 24 and a outlet 26 in the direction of Arrow G. The illustrated outlet 26, and the structures associated therewith, are the presently preferred example of a removal means for removing the gas from the gassification chamber 10. Other structures, however, can also function as the removal means of the present invention.

As a result of the outlet 26 being raised above the bottom of the gassification chamber 10, and the tuyére 22 being placed adjacent to the bottom of the gassification chamber 10, air for combustion is provided substantially only to the zone between the tuyére 22 and the outlet 26. Thus, as the tires in this "combustion zone" are consumed, additional tires held in the "storage zone" above the combustion zone are being heated and, as the tires T in the combustion zone are consumed, the tires in the storage zone gradually fall into the combustion zone. Thus, the amount of gas, and the BTU content of the gas, produced throughout the operation of the embodiment is relatively constant.

The gases leave the gassification chamber 10 through the outlet 26 and enter a low pressure injection burner 36. The low pressure injection burner 36 includes an inner cylindrical passageway (shown in cross section) where gas from the gassification chamber 10 travels as indicated by Arrows G. A blower 30 (which can preferably be one identified in Grainger catalog no. 376 as no. 4C054) injects a high velocity air stream, indicated by Arrows A, into the structure.

The structure of the low pressure injection burner 36 produces a venturi effect resulting from the high velocity air stream and the pressure created in the gassification chamber 10 by blower 28. The draft created thereby moves the combustible gas from the gassification chamber 10 into the low pressure injection burner 36 and into a primary combustion zone, indicated generally at bracket 38, in a combustion chamber 39. It should be appreciated that the combustion chamber 39 can be located a distance from the gassification chamber 10 if desired. A shut off damper 32, and its accompanying actuator 34, are provided to close off air to the low pressure injection burner 36 if the draft created without the blower 30 operating is sufficient.

The combustible gases entering the primary combustion zone 38 are ignited by an electric arc generated by electrodes 42 and a voltage step-up circuit 44. The electrodes 42 and the voltage step-up circuit 44, and the necessary accompanying devices, are preferably of the type known to those dealing in the jet engine ignition art and function as the presently preferred example of the ignition means of the present invention.

The illustrated structure for the low pressure injection burner 36 and the structures for the electrodes 42 located in the combustion chamber 39 are, by way of example only and not limitation, the presently preferred structure for the primary combustion means of the present invention. Importantly, structures other than those illustrated herein can also be used within the scope of the present invention.

The products of the combustion which occurs in the primary combustion zone are monitored by a gas detection sensor, preferably an oxygen sensor 46. The output of the oxygen sensor 46 is monitored, manually or preferably by an automated control system including dedicated or general purpose digital computing circuitry, and the amount of air introduced into gassification chamber 10 by blower 28, and into the low pressure injection burner 36 by blower 30 is controlled to arrive at the stoichiometrically correct concentration of combustible gas in the combustion chamber 39. The structure of the low pressure injection burner allows the air moved by the blower 30 to be warmed by the hot combustible gas as it leaves the gassification chamber 10.

The burning gases produce a draft in the combustion chamber 39 which causes the gases, both combustion products and any unburned gases, to rise into the secondary combustion zone, generally indicated at bracket 40, of the combustion chamber 39. The oxygen content of the gases at the upper end of the secondary combustion zone 40 is monitored by another oxygen sensor as is known in the art. The amount of oxygen detected by the oxygen sensor 48 is used to adjust the operation of a secondary combustion blower 54 (which can desirably be one of the before specified blowers) and, desirably, the operation of the other blowers represented in the preferred embodiment of the invention.

It will be appreciated that as the volume of air forced through combustion tuyére 56 is adjusted, the completeness of the combustion process can be optimized. The combustion tuyére 56, blower 54, and the structures associated therewith are just one example of a secondary combustion means of the present invention. While the temperature of the tires burning in the gassification chamber 10 is relatively low, the temperature within the combustion chamber 39 is high, for example, over 1000° F. Thus, substantial useful heat is generated by the apparatus of the present invention.

The represented apparatus very efficiently disposes of used tires while producing acceptable amounts of pollutants and significant amounts of useful heat. For example, one embodiment of the present invention constructed in accordance with this disclosure exhausted, on average, less than 1 ppm sulfur dioxide, 10 ppm halogenated hydrocarbons, and 120 ppm carbon monoxide. The embodiment also produced results as low as 10 ppm benzene, 29 ppm toluene, and 88 ppm gasoline range of hydrocarbons, and as high as 188 ppm benzene and 587 ppm gasoline range of hydrocarbons, during operation. The achieved results indicate that the amount of oxygen introduced into the combustion process can greatly reduce the emitted pollutants. Thus, the levels of pollutants produced by the preferred embodiment of the present invention are within generally acceptable limits.

The combustion chamber 39 is provided with a flue 50. The heat produced in the combustion chamber 39 passes through the flue 50 into a heat utilizing device 52. The heat utilizing device 52 can be a heat exchanger or some other type of device which will utilize the substantial heat which exits from the flue 50.

In view of the forgoing, it will be appreciated that the present invention provides an efficient and economical system and method for disposing of used tires and the like and for creating useful energy therefrom. The present invention also provides a system and method for disposing of used tires and creating useful energy therefrom which maintains any emitted pollutants at or below acceptable levels and which generates a dependably constant supply of energy during the operation of the system.

The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A system for disposing of a material such as vehicle tires and similar substantially organic matter and generating useful heat therefrom, the system comprising:

gassification means for holding an amount of the material to be disposed while the material is allowed to partially combust and for containing combustible gas produced thereby, the gassification means comprising a substantially air tight gassification chamber having at least one access way for inserting the material therein;

inlet means for receiving a controlled amount of oxygen containing gas into the gassification means, the inlet means comprising a tuyére disposed in the air tight gassification chamber and a blower connected to the tuyére;

removal means for removing the combustible gas from the gassification means, the removal means comprising a gas outlet located above the tuyére in the gassification chamber such that substantially amounts of the combustible gases produced by the partially combusted material exits through the gas outlet;

primary combustion means for receiving and mixing the combustible gas removed from the gassification means with an oxygen containing gas and burning the combustible gas; and means for directing the combustion products to a heat utilizing device.

2. A system for disposing of a material such as vehicular tires and similar substantially organic matter and generating useful heat therefrom as defined in claim 1 wherein the temperature in the gassification means is less than about 400° F.

3. A system for disposing of a material such as vehicular tires and similar substantially organic matter and generating useful heat therefrom as defined in claim 1 wherein the primary combustion means comprises:

blower, and ignition means for igniting the mixture of combustible gas and oxygen containing gas.

4. A system for disposing of a material such as vehicular tires and similar substantially organic matter and generating useful heat therefrom as defined in claim 3 wherein the primary combustion means further comprises means for warming the oxygen containing gas prior to its mixing with the combustible gas.

5. A system for disposing of a material such as vehicular tires and similar substantially organic matter and generating useful heat therefrom as defined in claim 3 wherein the ignition means comprises an electric arc producing device.

6. A system for disposing of a material such as vehicular tires and similar substantially organic matter and generating useful heat therefrom as defined in claim 3 wherein the primary combustion means comprises means for shutting off the oxygen containing gas.

7. A system for disposing of a material such as vehicular tires and similar substantially organic matter and generating useful heat therefrom as defined in claim 1 wherein the means for directing the combustion products comprises a combustion chamber.

8. A system for disposing of a material such as vehicular tires and similar substantially organic matter and generating useful heat therefrom as defined in claim 7 further comprising secondary combustion means for burning any remaining combustion products, the secondary burner means positioned in the combustion chamber in the flow of the combustion products.

9. A system for disposing of a material such as vehicular tires and similar substantially organic matter and generating useful heat therefrom as defined in claim 8 wherein the secondary combustion means comprises:

a tuyére located in the combustion chamber; and a blower connected to the tuyére.

10. A system for disposing of a material such as vehicular tires and similar substantially organic matter and generating useful heat therefrom as defined in claim 8 further comprising:

a first gas sensor positioned to monitor the combustion products of the primary combustion means;

a second gas sensor positioned to monitor the combustion products of the secondary combustion means; and means for controlling the inlet means, the primary combustion means, and the secondary combustion means in response to the first and second gas sensors to optimize the generation of pollutants and useful heat.

11. A system for disposing of a material such as vehicular tires and similar substantially organic matter and generating useful heat therefrom as defined in claim 10 wherein the means for controlling comprises a microprocessor.

12. A system for disposing of a material such as vehicular tires and similar substantially organic matter and generating useful heat therefrom as defined in claim 10 wherein the first gas sensor comprises an oxygen sensor.

13. A system for disposing of a material such as vehicular tires and similar substantially organic matter and generating useful heat therefrom as defined in claim 1 wherein the heat utilizing device comprises a heat exchanger.

14. A tire gassification and combustion system comprising:

a first chamber capable of holding a plurality of tires;

an access way in the first chamber for inserting whole tires therein;

a first air inlet positioned substantially at the bottom of the first chamber;

a first blower connected to the first air inlet;

a gas outlet positioned a first distance above the bottom of the first chamber;

a second chamber, the gas outlet connected to the lower end of the second chamber;

a second air inlet positioned at the lower end of the second chamber;

a second blower connected to the second air inlet;

ignition means positioned in the second chamber adjacent to the second air inlet;

a third air inlet positioned a first distance from the bottom of the second chamber;

a third blower connected to the third air inlet; and an exhaust outlet positioned in the second chamber, the hot combustion products exiting from the second chamber through the exhaust outlet.

15. A tire gassification and combustion system as defined in claim 14 further comprising a heat exchanger, the heat exchanger connected to the exhaust outlet and receiving the hot combustion products.

16. A tire gassification and combustion system as defined in claim 14 wherein the gas outlet is positioned a first distance above the bottom of the chamber and wherein the gas outlet is positioned approximately at the center of the first chamber.

17. A tire gasification and combustion system as defined in claim 14 wherein the first air inlet comprises a circular tuyére.

18. A tire gassification and combustion system as defined in claim 14 further comprising means for warming the air entering the second air inlet before it enters the second chamber using the hot gas which exits from the first chamber.

19. A tire gasification and combustion system as defined in claim 14 further comprising:

at least one oxygen sensor located in the second chamber; and means for controlling the first blower, the second blower, and the third blower in accordance with the measurement of the oxygen sensor so as to optimize the generation of useful heat and minimize pollutants resulting from the operation of the system.

20. A method for disposing of material such as vehicular tires and similar substantially organic matter and generating useful heat therefrom, the method comprising:

burning the material in a closed gassification chamber at a relatively low temperature to generate a combustible gas;

controlling the amount of oxygen containing gas entering the closed gassification chamber to control the burning of the materials;

removing the combustible gas from the gassification chamber;

mixing the combustible gas removed from the gassification chamber with an oxygen containing gas a first time and burning the combustible mixture in a combustion chamber;

mixing the combustion products with oxygen containing as a second time and further burning the combustion products;

monitoring the composition of the combustion products and adjusting the amount of oxygen containing gas which is mixed with the combustible gas and the combustion products; and directing the combustion products from the chamber to a heat utilizing device.

21. A method for disposing of material such as vehicular tires and similar substantially organic matter and generating useful heat therefrom as defined in claim 20 wherein the step of mixing and burning the combustible gas comprises the step of igniting the combustible gas using an electric arc.

* * * * *